US006130645A

United States Patent [19]

Lindenmeier et al.

[11] Patent Number: 6,130,645

[45] Date of Patent: Oct. 10, 2000

[54] COMBINATION WIDE BAND ANTENNA AND HEATING ELEMENT ON A WINDOW OF A VEHICLE

[75] Inventors: Heinz Lindenmeier, Planegg; Jochen Hopf, Haar; Leopold Reiter, Gilching, all of Germany

[73] Assignee: FUBA Automotive GmbH & Co. KG, Bad Salzdetfurth, Germany

[21] Appl. No.: 09/231,555

[22] Filed: Jan. 14, 1999

[30] Foreign Application Priority Data

Jan. 14, 1998 [DE] Germany ..... 198 01 156
Jun. 7, 1998 [DE] Germany ..... 198 25 552

[51] Int. Cl.[7] ..... H01Q 1/02; H01Q 1/32

[52] U.S. Cl. ..... 343/704; 343/713

[58] Field of Search ..... 343/704, 713; H01Q 1/02, 1/32

[56] References Cited

U.S. PATENT DOCUMENTS 4,583,097 4/1986 Kropielnicki ..... 343/704

FOREIGN PATENT DOCUMENTS 26 50 044 11/1979 Germany .

*Primary Examiner*—Michael C. Wimer
*Attorney, Agent, or Firm*—Collard & Roe, P.C.

[57] ABSTRACT

An antenna for transmitting and/or receiving in the heating field of a window pane on a motor vehicle. The heating field has an HF-connection designed to couple or decouple high-frequency signals, and heating connections for feeding the heating power. An AC generator generates the heating wattage in the form of AC current, through a transformer. The heating power is supplied to the primary winding of the transformer and picked up on the secondary winding of the transformer and supplied to the heating field via heating connections. The primary winding and the secondary winding of the transformer are insulated to reduce the transmission of high frequency currents so that the heating field antenna does not have low resistance even at the lowest frequencies.

25 Claims, 7 Drawing Sheets

COMBINATION WIDE BAND ANTENNA AND HEATING ELEMENT ON A WINDOW OF A VEHICLE

BACKGROUND OF THE INVENTION

The invention relates to an antenna for transmitting and/or receiving signals in the window pane of a motor vehicle. The antenna consists of a heating field applied to a window pane as an antenna conductor.

THE PRIOR ART

The prior art has shown a receiving antenna of this type from P 26 50 044. With this antenna, the heating field serves as an antenna for receiving the long-, medium- and short-wave (IMS) signals and the ultra-short wave signals. The feed of the direct current (dc) for the heating field represents a special problem in connection with this antenna. These problems occur particularly in the long-, medium- and short-wave ranges, where the heating field forms a high-resistance antenna element due to the low frequency.

Thus, the feeding of large direct currents required for heating the windshield is always connected with substantial damping of the receive signals. In contrast, the present invention shows the heating currents fed via a bifilar coil with the coil or choke being connected in parallel with the antenna element with respect to the high-frequency signals.

However, as shown in the prior art, if the antenna circuit is directly connected via a branch connection to the antenna-like heating elements, this will only lead to unsatisfactory reception.

Furthermore, it is not possible to design the reactance of the coil with a sufficiently wide-band for the long-, medium- and short-wave ranges so that connecting this element in parallel with the antenna will not noticeably affect the received signal.

A substitute circuit diagram shows inductor coil $L_D$ with its loss conductance $G_D$, the equivalent noise current source which is connected in parallel.

Because of the large heating currents in the bifilar windings of the coil it is not possible to have the inductor $L_D$ and the quality of the inductor sufficiently high. Therefore, there are two main drawbacks with this design. First, there is the load on the antenna impedance, which at low frequencies is described by capacitor $C_A$. The second drawback is that the signal-to-noise ratio at the output of the amplifier circuit is highly deteriorated by the large attenuation of the signal due to noise current noise current $i_R$. In modern motor vehicle technology, the antenna requires the reception of time transmitter DF 77 which transmits with a frequency of about 70 kHz. This is in addition to long-, medium- and short-wave reception. With an antenna of the prior art, it is not possible to construct an antenna at a reasonable expense by designing the bifilar coil. However, in the ultra-short wave range, the heating field forms a substantially low-resistance antenna element with little influence from_inductor $L_D$ in the received signal. Thus, through the design of the present invention, the direct current feed can be impeded more simply, and without high cost.

Therefore, the invention is designed to avoid the drawback posed by the inductance with the bifilar winding loading the antenna. In addition, it is possible to select the voltage for heating the window pane sufficiently high, to deviate from the battery voltage.

SUMMARY OF THE INVENTION

The invention relates to an antenna for transmitting and/or receiving long, medium, short, and ultra short wave signals in a heating field of a window pane on a motor vehicle. For purposes of radio and television reception, long wave signals (low frequency) are in the order of 100 kilohertz, medium wave signals (low frequency) are approximately 500 khz to 1.5 mhz, short wave signals (high frequency) are 4 mhz to 30 mhz and ultra short wave signals (high frequency) are signals above this range in the FM, VHF or UHF range. A goal of this design is to reduce the influence in the system between the DC Power generated to heat the heating field and the transmitted and received signals.

The heating field has a HF-connection designed to couple or decouple high-frequency signals, and heating connections for feeding the heating power to the heating element. An AC generator generates the heating wattage in the form of AC current, through a transformer. The heating power is supplied to the primary winding of the transformer and picked up on the secondary winding of the transformer and supplied to the heating field via conductors connected at heating connections. In addition, a rectifier circuit is used to change the AC current to DC current in these conductors. One end of the rectifier circuit connects to the secondary winding and another end of the rectifier circuit connects to a filter circuit. The filter circuit is used to smooth out the harmonics in the signals to give a more even DC signal to the heating field. Connected to the filter circuit are conductors which connect the filter circuit to the heating field.

To have low attenuation of the received signal throughout a wide range of frequencies, the primary winding and the secondary winding of the transformer are insulated to reduce the transmission of high frequency currents. In this way, the heating field antenna does not have to have low resistance even at the lowest frequencies. Furthermore, in one embodiment of the invention, coils are connected to these conductors to reduce high frequency signals in the system. These coils shield the heating field from high frequency signals.

The heating field can be formed in many different ways. For example, in one embodiment of the invention the heating field is a series of parallel spaced heating conductors connected at either side to a bus bar. In another embodiment of the invention, the heating field can consist of a series of heating fields with each heating field being galvanically separated from the other. In a third embodiment of the invention the heating field can be a flat electrically conductive layer that is transparent to light but reducing the transmission of heat.

Furthermore, the transformer can also consist simply of primary and secondary windings in a first embodiment or, it can contain a metallic screen and an insulator. The metallic screen and the insulator are located between the primary and secondary windings.

The antenna can also be used for TV and VHF reception. A series of multi antenna diversity system components are connected to the antenna. These diversity systems are connected through a series of amplifier circuits for VHF or TV reception.

One object of the invention is to provide an antenna for transmitting and receiving signals in a windowpane of a motor vehicle.

Another object of the invention is to provide an antenna that is powered by DC current.

Another object of the invention is to provide an antenna that is shielded from high frequency signals.

Still another object of the invention is to provide an antenna that is simple in design, inexpensive to manufacture and easy to install in a motor vehicle.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
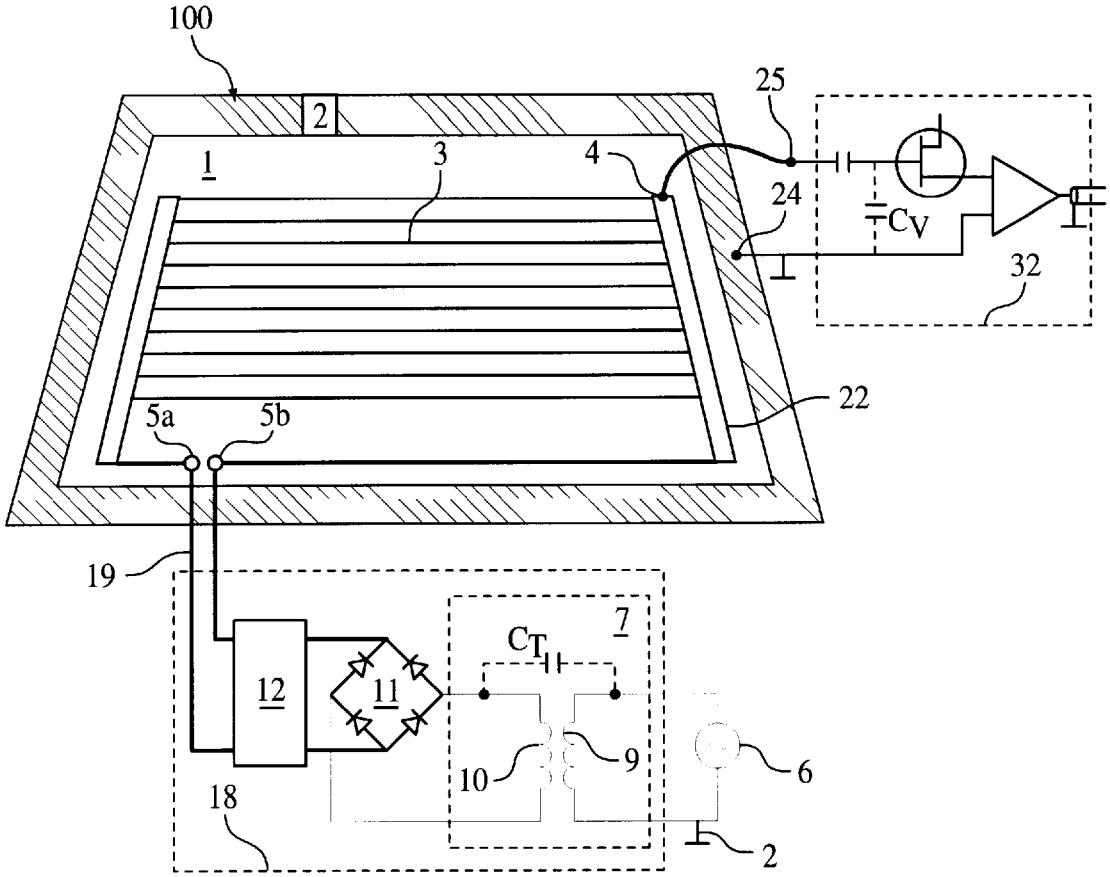
FIG. 1*a* shows a receiving antenna having decoupling of the high-frequency signal on the bus-bar.

Referring to FIG. 1*a*, there is shown a receiving antenna 100 located on a windowpane 1 having a ground element 2. Antenna 100 is for decoupling a high-frequency signal on a bus-bar 22 of a heating field 3 with the help of a high frequency HF-connection 4. Thus, the invention consists in part of feeding the electrical energy from an AC generator 6 to to heating connections 5*a* and 5*b* to heat a window area 1.

A transformer 7 is connected to generator 6 and operates without a ground coupling between an AC generator 6 and heating field 3. The only remaining coupling between AC generator 6 and heating field 3 is the transformer winding capacitance $C_T$ (FIG. 1*b*) between primary winding 9 and secondary winding 10. Thus, because an antenna and the heating element are fed with power through a transformer, the voltage sent to the heating element and antenna can be controlled. However, the heating system and antenna should be powered by direct current (DC) and not alternating current (AC). Therefore, rectifier circuit 11 is connected in series with transformer 7 and receives AC power from transformer 7. Rectifier circuit 11 changes the AC signal from AC generator 6 into a DC signal. Filter circuit 12 is connected to rectifier circuit 11 and flattens out any ripple effects from rectifier circuit 11.

The space capacitance of rectifier circuit 11 and filter circuit 12 versus shielded housing 18 adds up to a total capacitance $C_T$ (FIG. 1*b*) and, as a rule, can be neglected. Optimal signal- to-noise ratios are obtained if a high-impedance amplifier circuit for long medium and short wave reception (IMS) 32 is connected to HF-connection 4 with as low capacity as possible, thus via a short line. Amplifier circuit 32 functions as a field effect transistor (FET) having a substantially high impedance over other style amplifiers.

Figure 1B:
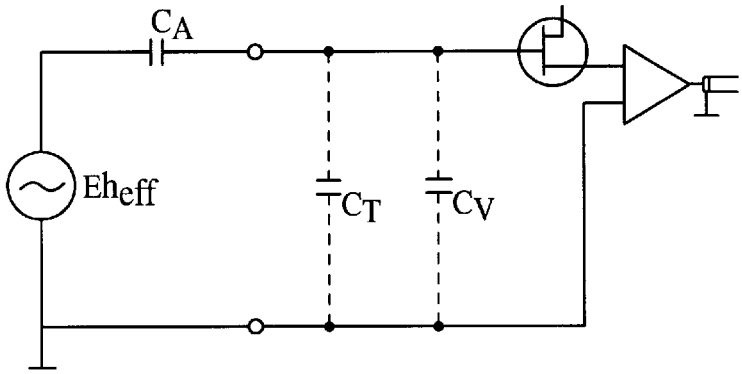
FIG. 1*b* shows the substitute circuit diagram of FIG. 1*a;*

FIG. 1*b* shows the equivalent circuit diagram of the antenna represented in FIG. 1*a*. The receiver open-circuit voltage $Eh_{eff}$ is the received voltage of the heating field versus the body of the vehicle. This voltage develops at frequencies whose wavelength is large as compared to the vehicle dimensions. In addition, this occurs largely independent of the mounting of HF-connection 4 and ground point 24.

Capacitor $C_A$ represents the capacitance of the heating field, which is described as the antenna capacitance and is approximately 250 pf. Capacitance $C_T$ and capacitance $C_V$ jointly form the load capacity of the capacitively acting heating field 3. Heating field 3 has a shortened connection to antenna contact 25. Moreover, the capacitance of high-impedance amplifier circuit connected to LMS 32, can be kept low, as compared to the impedance of capacitor $C_A$ of heating field 3. In this case, high impedance means an impedance that is not an order of magnitude lower than the impedance of heating field 3. Furthermore, if the high-impedance amplifier circuit for LMS 32 is disposed in a radio, removed via a feed line between HF-connection 4 and contact point 24, the advantage of frequency-independent reception is also achieved at low frequencies.

The present invention is designed to reduce the capacitive loading of antenna 100 by regulating the input feed of the heating power. In this design, it is possible to adapt the heating voltage to the resistance conditions of the heating surface. Thus, when thin, electrically conductive layers are used as the antenna and heating surface, higher voltages are required for heating than those that are available from the vehicle (12 volts). Therefore, FIG. 1*a* shows a transformer 7 being used wherein the transformer ratio can be realized by suitable voltage without restriction. Thus, the voltage may be stepped up to 80 volts.

The equivalent circuit diagram in FIG. 1*b* shows that the resulting arrangement does not have any lower limit frequency because of the voltage division between the capacitance of the heating surface and the amplifier capacitance. Thus, the capacitance of the transformer is connected in parallel, and it is not dependent upon the frequency as the frequency term cancels out.

Figure 2A:
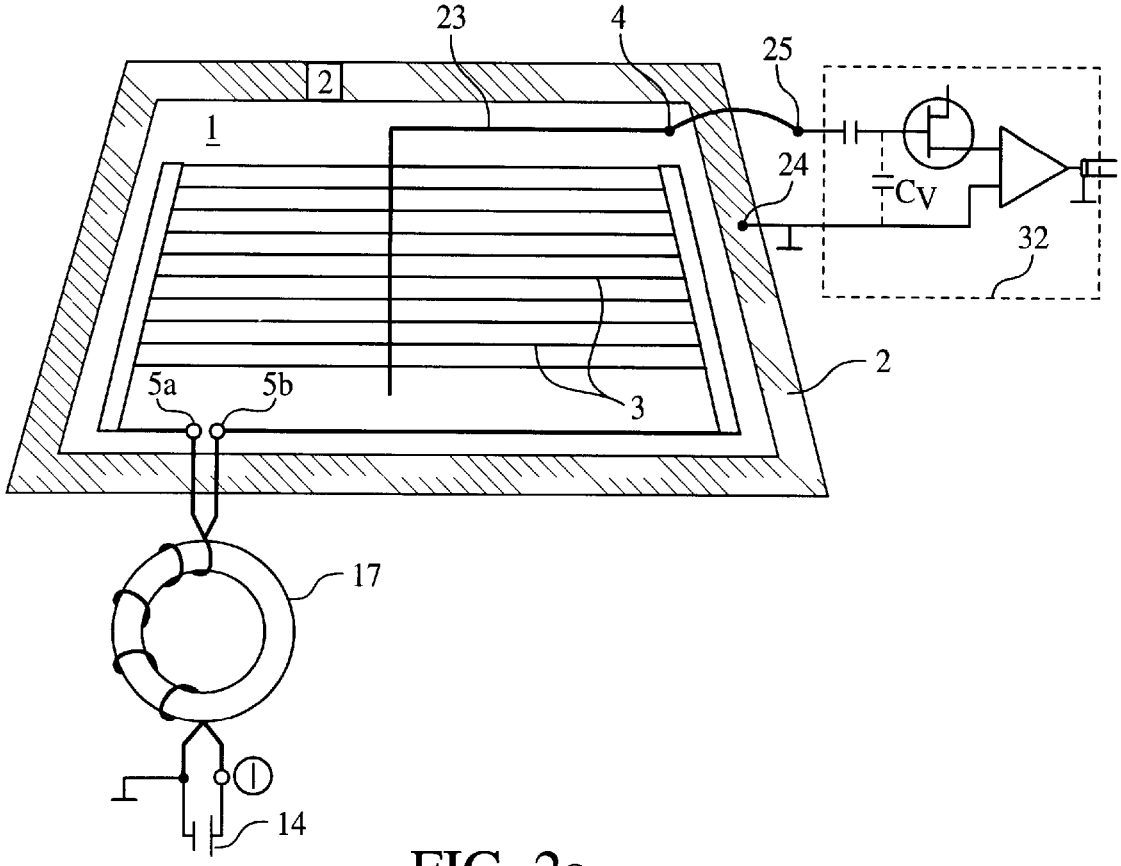
FIG. 2a PRIOR ART
FIG. 2*a* shows a receiving antenna according to the prior art.
Figure 2B:
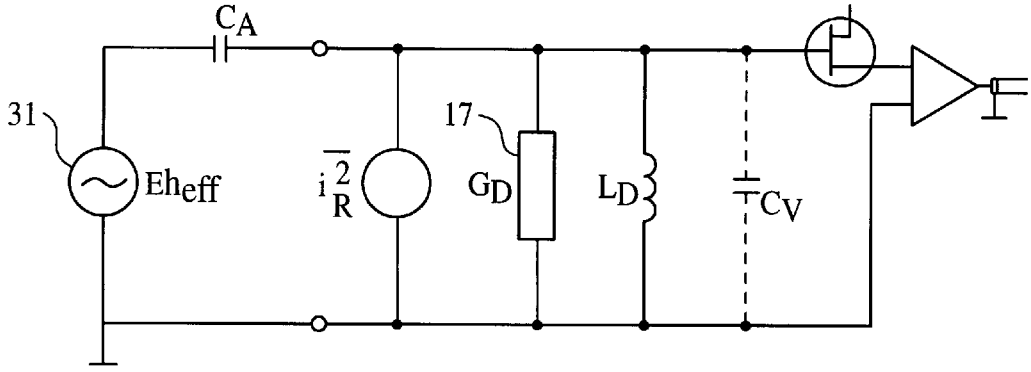
FIG. 2b PRIOR ART
FIG. 2*b* shows a substitute circuit diagram with the equivalent reactance loss of the coil, and its equivalent noise current source.

As opposed thereto, the equivalent circuit diagram for FIG. 2*a* shows the antenna according to the prior art with a corresponding high-pass filter as shown in FIG. 2*b*. Here, the high-frequency decoupling between the energy source 14 and heating field 3 occurs through an inductor $L_D$. The inductor is designed so that the heating current excites the magnetic material in the opposite sense as it is being conducted back and forth. Thus, the resulting magnetic fields cancel each other and the magnetic material, which is a ferrite core 17 in most cases, does not to magnetically saturate due to the high current.

This design of the prior art does have some problems. The special problems with this coil include its space requirements, and the losses due to the wire length needed to generate an adequately high inductive value $L_D$, (see FIG. 2*b*). In addition, there are also problems with the connection, and the loss of sensitivity caused by noise current source $i_R$. In this case, the loss conductance is shown as value $G_D$ in equivalent circuit diagram FIG. 2*b*, for the antenna circuit shown in FIG. 2*a*. This noise contribution is effective because of the resulting limited quality of reception.

Because of the large heating currents, it is not possible in practical applications to select $L_D$ sufficiently high to adequately reduce the noise contribution at frequencies in the long-wave range and below. The device has a narrow band width which is obtained by additionally connecting to it a capacitor, so that a resonance is produced with $L_D$, wherein the noise contribution could not be avoided. A generator 6 can be designed in the form of a vehicle generator 31.

Figure 3A:
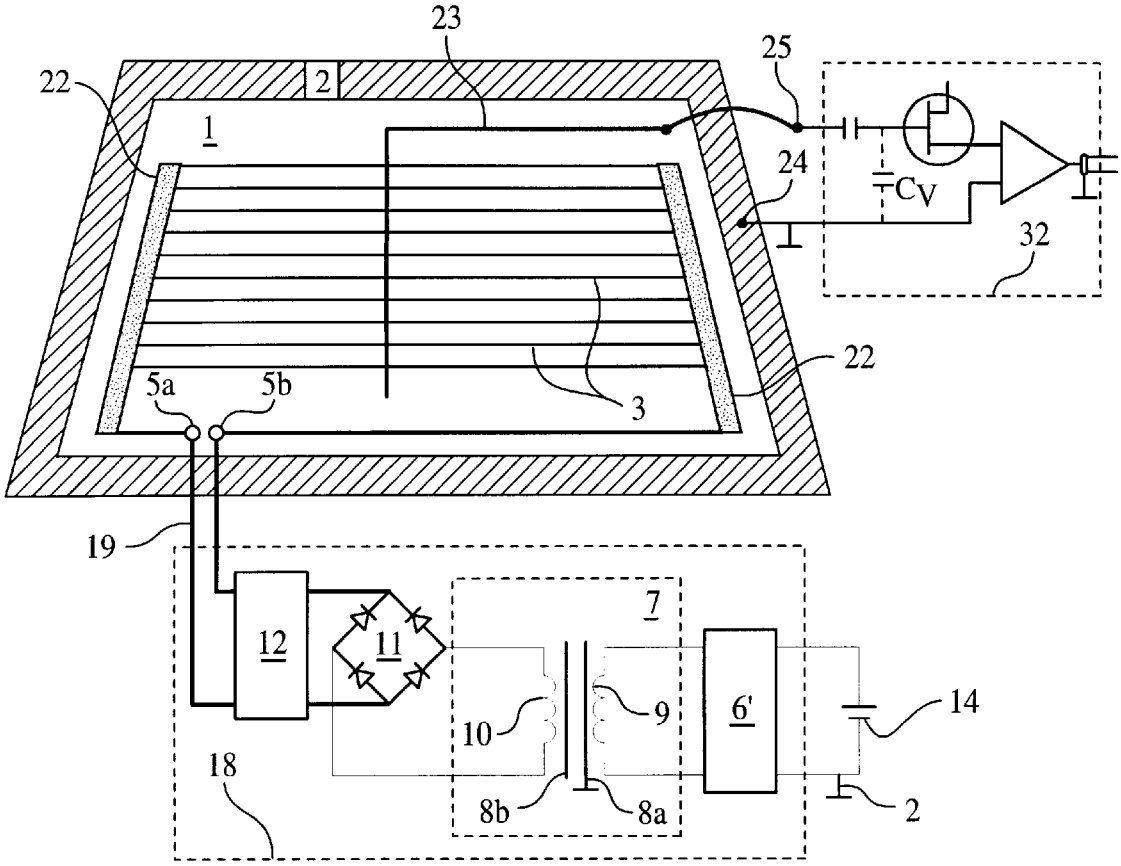
FIG. 3*a* shows a second embodiment of the invention.

FIG. 3*a* shows another advantageous embodiment of the invention, having a generator 6' designed in the form of a direct current/alternating current converter (DC-AC converter). This arrangement offers several advantages. First, the feed lines between battery 14 and the DC-AC converter conduct direct current, and the entire arrangement within shielded housing 18 can be accommodated within the vehicle near the antenna. A second advantage is that heating current feed line 19 from shielded housing 18 to heating field 3 up to terminals 5*a*, 5*b* will only conduct direct current. Thus, there is improved electromagnetic compatibility within the system.

Figure 3B:
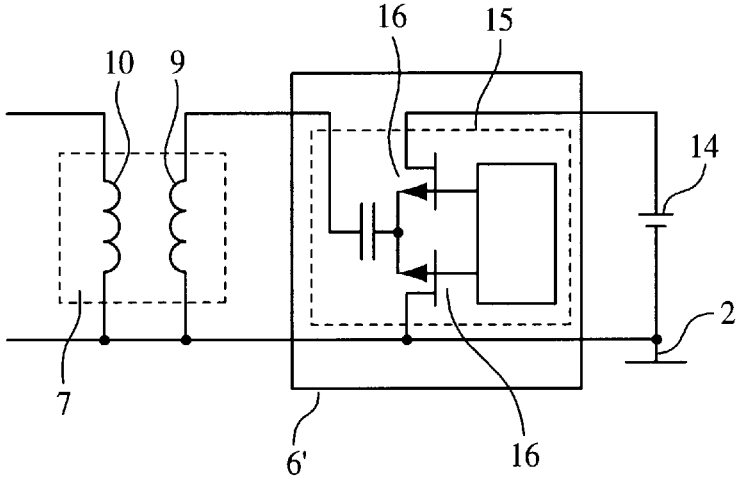
FIG. 3*b* shows a switching network with switching transistors.

The circuit of FIG. 3*a*, also shows a metallic screen 8*a*, which is connected to the ground of the vehicle. With the help of secondary winding 10 and insulation 8*b*, screen 8*a* can be designed sufficiently small relative to the electric ground of the vehicle. As shown in FIG. 3*b* when an electronic DC-AC converter is used in the form of a switching network 15 with switching transistors 16, the frequency of the generator can be selected within wide limits. Switching network 15 is connected at one end to battery 14 and at an opposite end to transformer 7. In addition, it can be favorably selected by taking into account electromagnetic interferences in the reception range. The cost required for filtering in filter circuit 12 is determined by the selection of the generator frequency. This type of expenditure is significant in view of the required heating wattage ranging from a few 100 watts up to 1 kW.

Figure 4:
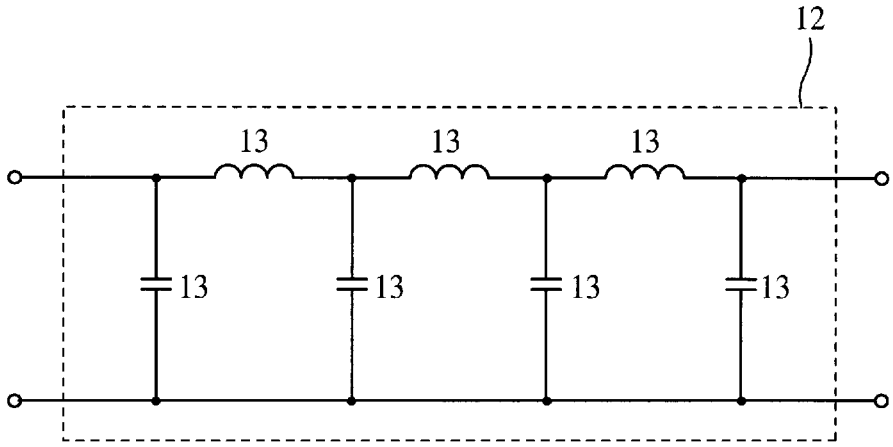
FIG. 4 shows a filter circuit consisting of a chain or tandem arrangement of C-L low pass filters.
Figure 5:
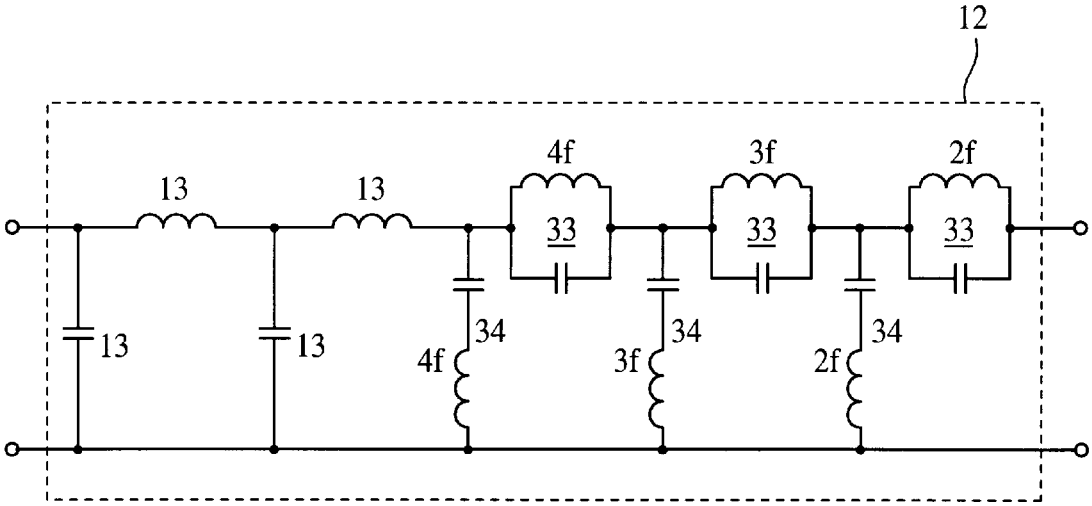
FIG. 5 shows a filter circuit consisting of a tandem circuit with parallel resonance circuits connected in series, and series resonance circuits connected in parallel.

An example of filter circuit 12 is shown in FIG. 4 in the form of C-L low pass filter 13. To suppress reception interferences, parallel resonance circuits 33 and the series-connected resonance circuits 34 are incorporated in filter circuit 12 as shown in FIG. 5. These circuits are designated as 2*f*, 3*f*, and 4*f*. These circuits form frequency traps or band elimination filters. Therefore, it is better to employ a fixed-frequency generator as a switching network component 15 rather than generator 31 with its frequency depending up on the speed.

Figure 6:
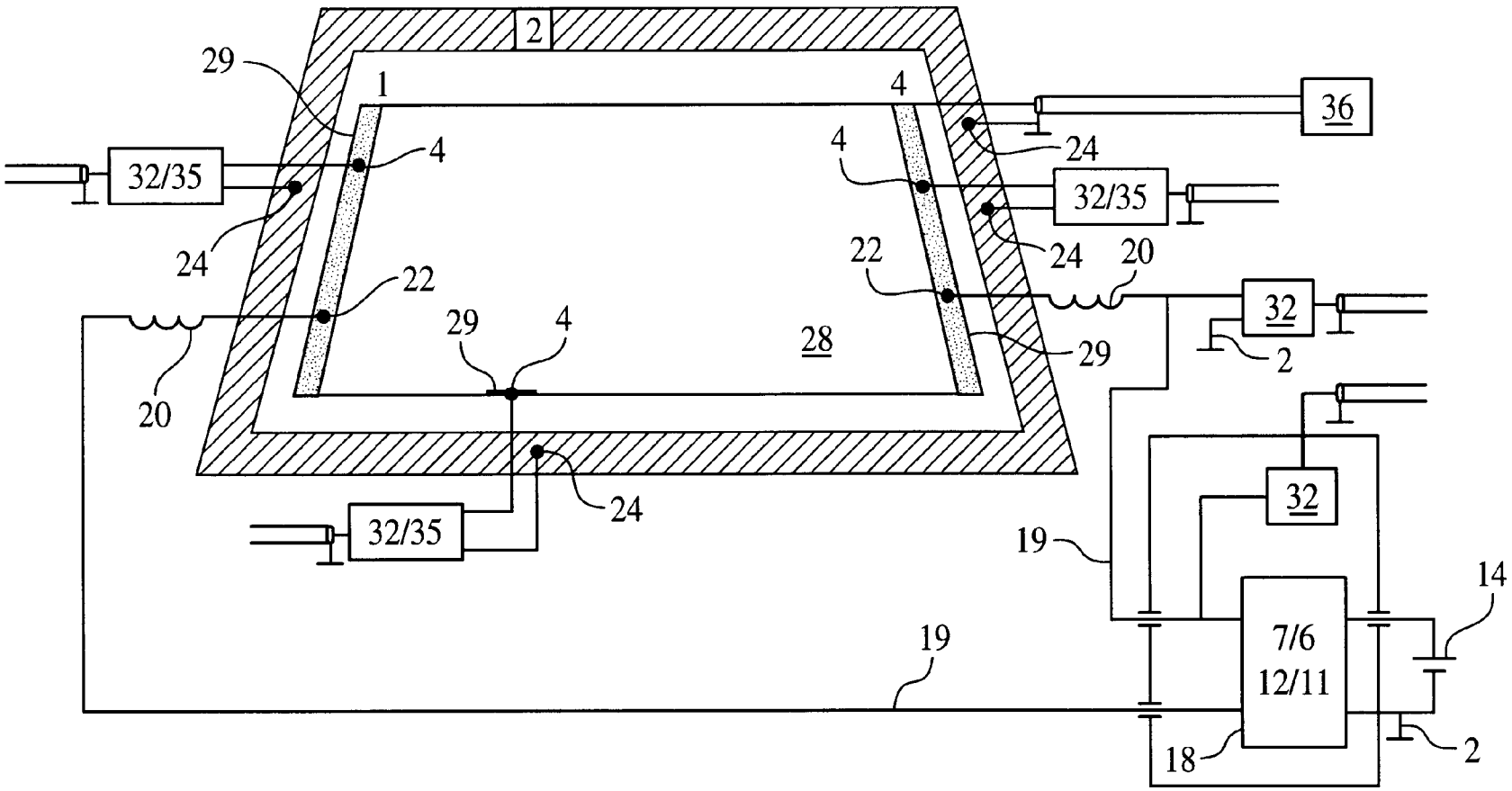
FIG. 6 shows a third embodiment of the invention for long, medium, short-wave and ultra-short wave reception.

FIG. 6 shows a receiving antenna for LMS-wave or LMS-wave and ultra-short wave reception. Heating field 3 is shown in the form of conductive surface 28. Surface 28 has a plurality of HF-connections 4 on bus-bars 22, or on an electrode 29 located on edge 30 of conductive surface 28. This electrode is grounded to surface 28. Connected to HF-connections 4 are components with high-impedance amplifier circuits for LMS 32, and amplifier circuits 35 for ultra-short wave or TV reception. The input impedance of these components in the LMS-wave frequency ranges is capacitively a high resistance. The figure shows which variation possibilities are available with respect to components 32 and 35 and for mounting the latter on conductive surface 28. The connection of a remotely installed auto radio 36 is indicated in FIG. 6 as a further alternative.

To feed the DC heating current to bus-bars 22 in FIG. 6, coils 20 are incorporated, which decouple feed lines 19 through impedance from bus-bars 22 in the higher frequency ultra-short wave range. FIG. 6 shows the interior of screen housing 18 as another alternative to accommodate the high-impedance amplifier circuit for LMS 32. Instead of using a thin electrically conductive layer 27 (FIG. 7), printed heating field as shown in FIGS. 1 and 3 is used, and a coupling conductor 23 is used instead of electrode 29.

Figure 7:
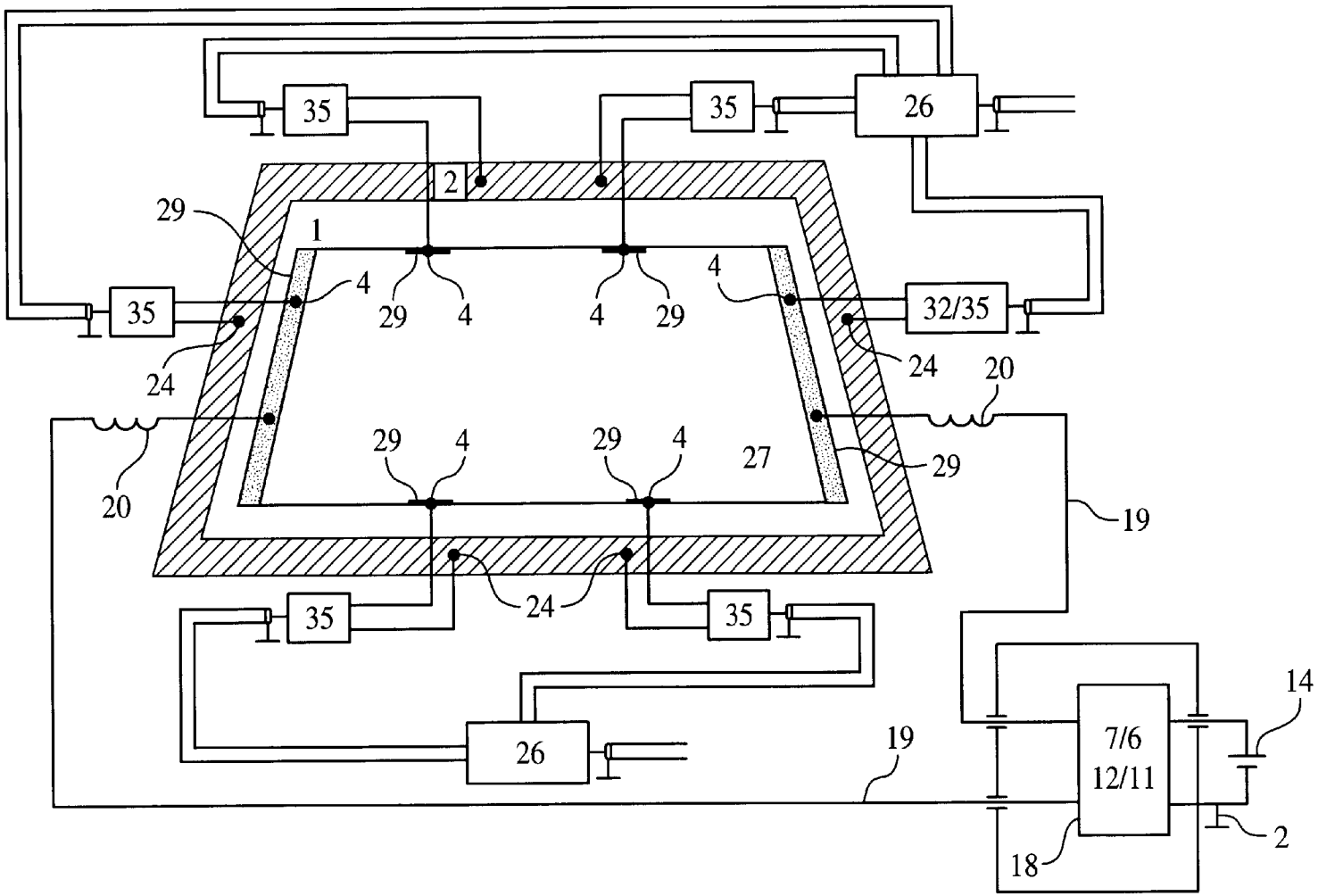
FIG. 7 shows a multi-antenna diversity system for the FM and TV frequency range.

FIG. 7 shows an antenna for TV and ultra short wave reception. This antenna contains a two multi-antenna diversity systems 26 that are each connected to at least two amplifier circuits 35 for VHF or TV reception. These amplifier circuits 35 connect to HF connections 4 on thin electrically conductive layer 27 and are grounded to ground point 24. Electrical power flows from battery 14 through conductor 19 and coils 20 to electrode 29 to power conductive layer 27. In this case, there is only one high-impedance amplifier circuit for LMS 32.

Figure 8:
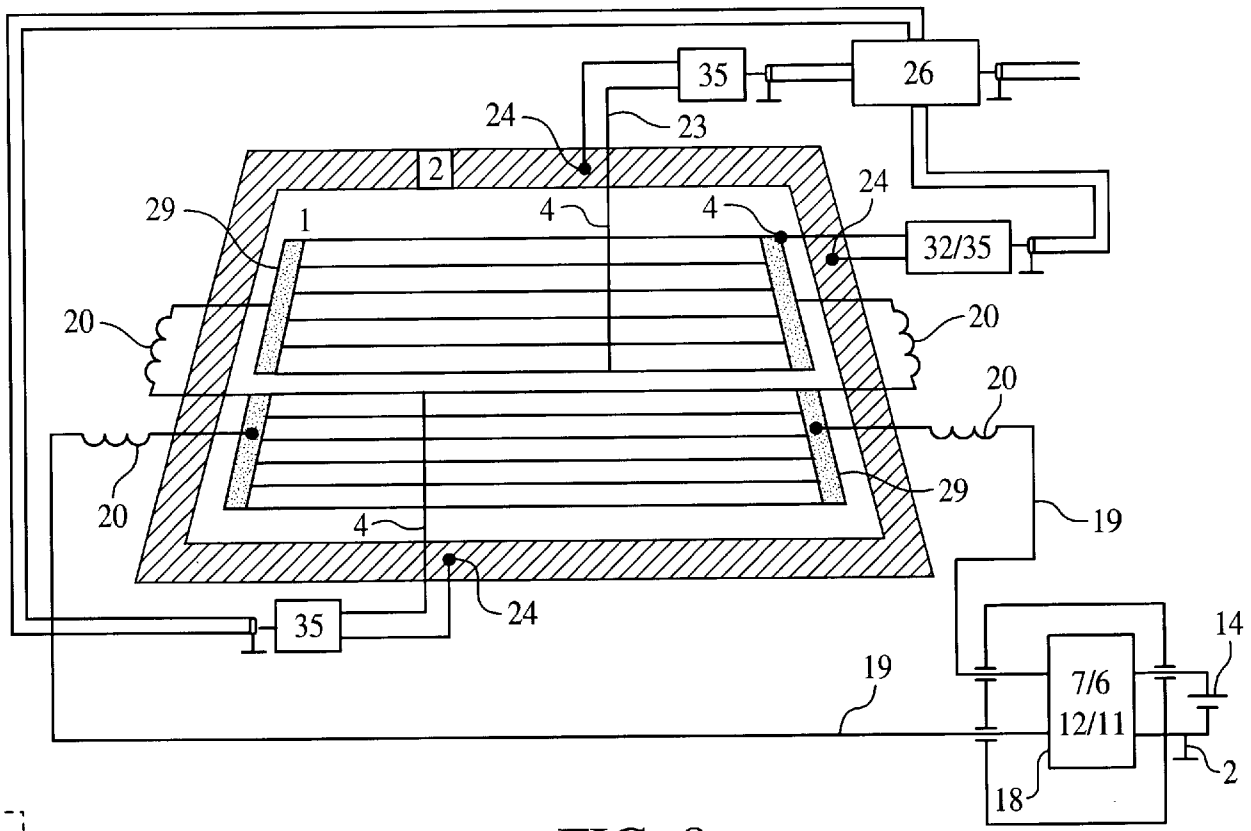
FIG. 8 shows a multi-antenna diversity system for the ultra-short wave range with two divided heating surfaces.

Similar to FIG. 7, FIG. 8 shows an antenna diversity system where several heating fields 3 are formed on the window by printed conductors. For frequencies of the LMS-wave ranges, these heating fields are connected to each other by coils or inductors 20 for the ultra-short wave range. Therefore, the sum of heating fields 3 acts as a receiving antenna for the LMS-wave ranges.

To obtain a particularly high noise sensitivity in the LMS-wave ranges, it is possible to employ an input transformer 37 in the high-impedance amplifier circuit for LMS 32. As opposed to transformer 7, this transformer may be geometrically very small, and can be manufactured with high quality and very high inductive values, so that the reception of low frequencies will not be impaired by the main inductance.

Figure 9:
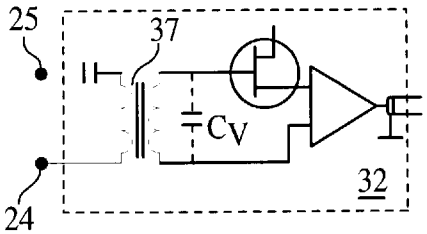
FIG. 9 shows a modified high-impedance amplifier circuit for long, medium and short-wave reception.

As shown in the circuit of FIG. 9, there is a modified high resistance circuit 32 that can be coupled to a ground contact 24 or an antenna contact 25. Circuit 32 contains input transformer 37 which permits the optimization of the signal-to-noise ratio.

Accordingly, while several embodiments of the present invention have been shown and described, it is to be understood that many changes and modifications may be made thereunto without departing from the spirit and scope of the invention as defined in the appended claims.

What is claimed is:

1. An antenna for transmitting and receiving signals in a windshield of a motor vehicle comprising:

at least one heating field located on the windshield and serving as an antenna conductor;

at least one electric ground connected to the motor vehicle;

at least one HF-connection connected to said at least one heating field for coupling or decoupling high-frequency signals;

a plurality of heating connections connected to said at least one heating field for feeding heating power onto said at least one heating field;

at least one transformer connected to said heating connections, said at least one transformer each having a primary winding and a secondary winding, wherein each winding is isolated from the other in terms of high-frequency and high resistance; and at least one AC generator connected to said at least one transformer for generating heating power as AC power, wherein power from said at least one AC generator passes through said at least one transformer to said at least one heating field so that the antenna is not loaded with low resistance by the heating connections even at its lowest operating frequencies.

2. The antenna according to claim 1, further comprising at least one rectifier circuit connected to said secondary winding of said at least one transformer and at least one filter circuit connected to said at least one rectifier circuit, wherein said at least one rectifier circuit changes the AC current to DC current so that said heating power is supplied to said heating connections as DC power.

3. The antenna according to claim 2, wherein said at least one rectifier circuit is designed as a two-way rectifier circuit, and said at least one filter circuit consists of a tandem connection made up by C-L low pass filters to reduce the ripple effect from the AC frequency.

4. The antenna according to claim 1, wherein the primary winding on said at least one transformer is connected to said at least one AC generator.

5. The antenna according to claim 1, wherein said at least one AC generator is connected to a battery and connected at high frequency to said electric ground, said generator supplying AC heating power to said at least one transformer via the primary winding connected to said AC generator.

6. The receiving antenna according to claim 2, wherein said at least one AC generator is designed as a fixed-frequency generator, and the at least one filter circuit consists of a tandem circuit comprised of a plurality of parallel resonance circuits connected in series, and a plurality of series resonance circuits connected in parallel, said at least one filter circuit containing a plurality of C-L low pass filters for generating harmonics as low as possible, wherein the resonances of said circuits are tuned to the harmonics of the AC frequency.

7. The antenna according to claim 5, wherein said at least one AC generator comprises a switching network having a plurality of switching transistors with a high efficiency and with a fixed switching frequency of the generated rectangular output voltage, wherein the switching frequency is selected so that its harmonic frequencies with the highest intensity do not interfere with any received radio bands.

8. The antenna as in claim 1, wherein said at least one transformer has a ferrite core and wherein a switching frequency is selected to reduce the harmonics as low as possible, so that as little energy as possible falls within the bands of the long-wave, medium-wave and short-wave ranges.

9. The antenna according to claim 2, wherein said at least one transformer, said at least one rectifier circuit, and said at least one AC generator are connected within a shielded housing which is connected to said ground, so as to avoid capacitive loading of the antenna, and wherein a plurality of conductors of the secondary winding are positioned to have capacitance within the shielded housing.

10. The antenna according to claim 1, further comprising a plurality of coils for shielding said at least one heating field from a high frequency signal transmitted by the secondary winding, and the plurality of feed lines, said coils being designed to not shield in the LMS-frequency ranges, but are adequately high-resistant in the ultra-short wave frequency range and ranges.

11. The antenna according to claim 1, wherein said at least one heating field comprises a plurality of substantially horizontal heating conductors, at least one bus-bar connected to an end of each heating conductor, and a coupling conductor having a high frequency connection to at least one of said heating conductors, or to an end of said bus-bar, jointly, with said ground forming the antenna contact.

12. The receiving antenna according to claim 11, wherein a series of signals in the LMS-wave frequency range are decoupled on said at least one HF-connection to form a multi-antenna diversity system in the FM or TV-frequency range.

13. The antenna according to claim 1, wherein said at least one heating field is formed by an electrically conductive layer secured flat to an area of the windshield, said layer being transparent to light but reducing the transmission of heat.

14. The antenna according to claim 13, wherein the conductive layer has limited conductivity and non-negligible surface resistance, so that to feed a heating current, a substantially flat highly conductive electrode is formed for each connection to said layer.

15. The antenna according to claim 14, wherein the output AC voltage of the AC generator and the transformer ratio of the transformer are coordinated with each other so that the dc voltage available at the output of the rectifier circuit is sufficient to heat the window and transmit signals through the highly resistant layer with limited conductivity.

16. The antenna according to claim 14, wherein said at least one HF-connection is formed by connection to at least one electrode, wherein said at least one electrode is connected with low loss at high frequency to said at least one surface; said electrode having an electrode edge with a length that is at least sufficiently large to make the loss contributed by said surface sufficiently low within the region of said edge.

17. The receiving antenna according to claim 1, wherein said at least one HF-connection comprises at least two heating connections, said antenna further comprising a plurality of electrodes separated from each other and distributed over the circumference of the at least one heating field wherein a plurality of antenna contacts are formed for signals at frequencies above the LMS-wave frequency ranges, with at least one antenna contact for LMS-wave signals, said antenna designed to form a multi-antenna diversity system in the FM or TV frequency range.

18. The antenna according to claim 1, further comprising a plurality of heating fields galvanically separated from each other with at least two heating fields having heating connections wherein said antenna further comprises coils connected to a plurality of heating lines for decoupling frequencies above the LMS-wave frequency ranges; wherein said secondary winding supplies heating current for the individual part surfaces and said antenna is designed to form a multi-antenna diversity system in the FM- or TV-frequency range.

19. The antenna according to claim 18, wherein the secondary winding supplies power through parallel switching.

20. The antenna according to claim 18, further comprising a plurality of separate secondary windings each connected to said at least one transformer said secondary windings for supplying power to the antenna.

21. The antenna according to claim 18, wherein said at least one transformer comprises a plurality of transformers each having secondary windings for supplying power to the antenna.

22. The antenna according to claim 11, wherein the coupling conductor is wholly or partly formed by one of the feed lines feeding the secondary winding.

23. The receiving antenna according to claim 1 wherein a low-noise amplifier circuit with high impedance on the input side is connected to the at least one HF-connection for LMS-wave reception.

24. The antenna according to claim 23, further comprising an input transformer connected upstream of the high impedance amplifier circuit on the input side, wherein the input inductance of said input transformer is selected sufficiently high and its transformation ratio is selected at a rate wherein an optimal signal-to-noise ratio is adjusted with inclusion of a transistor capacity Cv in the low frequency range.

25. The antenna according to claim 1, further comprising a metallic screen between the primary winding and connected to the electric ground, and further comprising an insulator inserted between said screen and the secondary winding to reduce the capacity between the windings.

* * * * *